US007988019B2

(12) United States Patent
Groh

(10) Patent No.: US 7,988,019 B2
(45) Date of Patent: Aug. 2, 2011

(54) BEVERAGE TAP PLUG

(75) Inventor: James K. Groh, Ottawa, IL (US)

(73) Assignee: Banner Beverage Systems Company, Morris, IL (US)

( * ) Notice: Subject to any disclaimer, the term of this patent is extended or adjusted under 35 U.S.C. 154(b) by 656 days.

(21) Appl. No.: 11/712,810

(22) Filed: Feb. 28, 2007

(65) Prior Publication Data

US 2008/0203113 A1 Aug. 28, 2008

(51) Int. Cl.
*B67D 1/07* (2006.01)
*B65D 25/42* (2006.01)
*B65D 51/00* (2006.01)

(52) U.S. Cl. ..... 222/151; 222/563; 15/211; 15/244.4; 401/207; 215/355; 215/358

(58) Field of Classification Search ..... 222/151, 222/546, 563; 15/211, 244.1, 244.4; 401/126, 401/198, 207; 215/355, 361, 364, 358
See application file for complete search history.

(56) References Cited

U.S. PATENT DOCUMENTS

| | | | | | |
|---|---|---|---|---|---|
| 467,599 | A * | 1/1892 | Abundi et al. | 604/212 |
| 2,315,054 | A * | 3/1943 | Heber | 15/244.1 |
| 3,214,780 | A * | 11/1965 | Sharpe | 401/185 |
| 3,352,762 | A | 11/1967 | Weiner | |
| 3,823,848 | A | 7/1974 | Schuster et al. | |
| 3,966,334 | A * | 6/1976 | Forsberg | 401/198 |
| 4,675,159 | A | 6/1987 | Al-Sioufi | |
| 4,964,438 | A | 10/1990 | Welty | |
| 5,109,997 | A | 5/1992 | Phillips | |
| D337,726 | S | 7/1993 | O'Neill | |
| 5,516,006 | A * | 5/1996 | Meshberg | 222/562 |
| 5,735,425 | A | 4/1998 | Beadle | |
| 6,221,451 | B1 * | 4/2001 | Lauer et al. | 215/355 |
| 6,296,410 | B1 * | 10/2001 | Ruizendaal | 401/207 |
| 6,648,178 | B2 | 11/2003 | Grunewald | |
| 6,763,961 | B2 * | 7/2004 | Gardner et al. | 215/364 |
| 6,824,015 | B1 | 11/2004 | Ammann | |
| 2005/0199631 | A1 * | 9/2005 | Alois | 220/375 |
| 2006/0011669 | A1 * | 1/2006 | Massey | 222/563 |

OTHER PUBLICATIONS

U.S. Appl. No. 11/125,903, filed Sep. 15, 2005, Alois.
U.S. Appl. No. 11/073,612, filed Sep. 8, 2005, Pham.
U.S. Appl. No. 11/193,222, filed Nov. 25, 2005, Permuy.
U.S. Appl. No. 10/892,093, filed Jan. 19, 2006, Webb.

* cited by examiner

*Primary Examiner* — Kenneth Bomberg
(74) *Attorney, Agent, or Firm* — Greenberg Traurig LLP

(57) ABSTRACT

The present invention relates to a beverage tap plug for occupying and disinfecting, cleaning, or sanitizing a faucet opening of a beverage tap. The beverage tap plug comprises a support member supporting a resilient absorbent member. The absorbent member comprises a generally cylindrical column of absorbent material. The support member of the beverage tap plug comprises a relatively flat, disk-shaped base supporting a thin post in which the post defines a longitudinal axis with a first base end and second distal end. The post protrudes outwardly from the center of the base at the base end. Additionally, the outside diameter of the absorbent member is larger than the diameter of the diameter of the outer rim of the faucet opening. The absorbent member of the beverage tap plug is impregnated with a disinfectant, sanitizer or cleaner.

11 Claims, 2 Drawing Sheets

Fig. 1
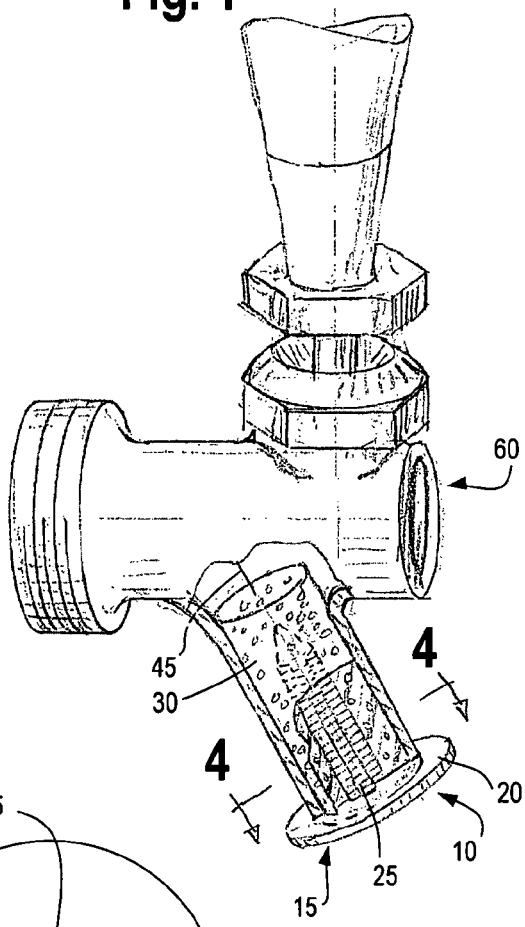
Fig. 2
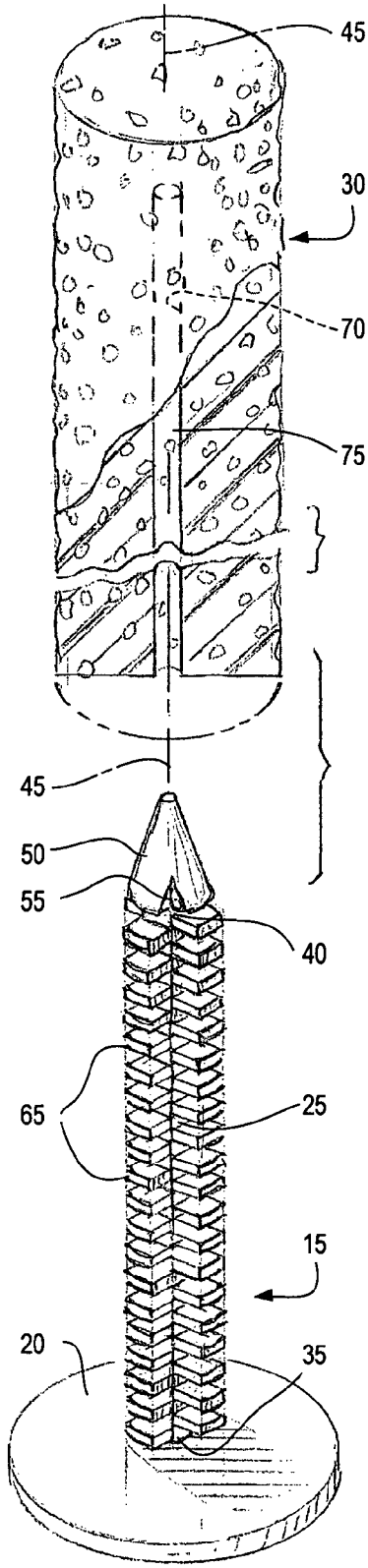
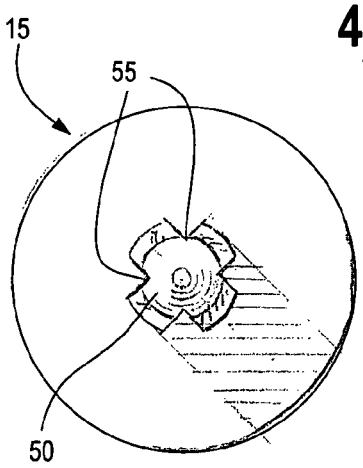
Fig. 3
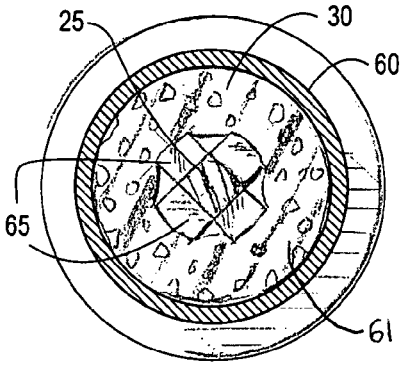
Fig. 4

BEVERAGE TAP PLUG

BACKGROUND OF THE INVENTION

1. Field of the Invention

The present invention relates to the disinfecting, sanitizing, or cleaning of beverage tap faucet interiors and rims and, in particular, to beverage tap plugs designed to be placed inside the faucet opening of a beverage tap in order to more efficiently disinfect, sanitize, or clean the beverage tap faucet interior.

2. The Prior Art

Some of the major issues that arises with beer or beverage taps are that these taps can harbor stale beverage remnants or unsanitary particulates, as well as promote the growth of bacteria and/or various other microorganisms. The prior art generally deals with these issues in one of two ways: 1) the prior art either requires the manual scrubbing and cleaning of the beverage tap every at regular intervals, which can be a tedious and rigorous process, or 2) the prior art discloses plugging up the beverage tap using a tap plug (an example of which is described in U.S. patent application Ser. No. 11/125,093, titled Beverage Tap Spout Plug, published Sep. 15, 2005) thus creating a physical barrier between the inside surface of the tap and the outside air. Manually cleaning or scrubbing the beverage tap has the disadvantage of not only being tedious, but once the cleaning is completed, microorganisms can still be reintroduced to the beverage tap from its exposure to air. On the other hand, the problem with the prior art tap plugs is that they do not disinfectant, sanitize, or clean any of the undesirable particulates or microorganisms that are already in the beverage tap. Thus, it is an object of this invention to provide a tap plug that can not only disinfect, sanitize, or clean a beverage tap, but also reduce the reintroduction or growth of more microorganisms.

It is a further object of this invention to perform the above function in a simple and cost effective manner.

These and other objects of the inventions will become apparent upon review of the following claims, specification, and drawings.

SUMMARY OF THE INVENTION

The present invention relates to a beverage tap plug for occupying and disinfecting, sanitizing, or cleaning a faucet opening of a beverage tap. The beverage tap plug comprises a support member supporting a resilient absorbent member. The absorbent member comprises a generally cylindrical column of absorbent material capable of being impregnated with a disinfectant, sanitizer or cleaner.

The support member of the beverage tap plug comprises a relatively flat, disk-shaped base supporting a thin post in which the post defines a longitudinal axis with a first base end and second distal end. The post protrudes outwardly from the center of the base at the base end. Additionally, the outside diameter of the absorbent member is larger than the diameter of the outer rim of the faucet opening.

Additionally, The beverage tap plug further comprises a plurality of fins which extend radially outwardly from the post. The fins preferably have a slight downward bias towards the base of the support member.

In a preferred embodiment, the plurality of fins extends along substantially the entire length of the post.

Also, the post of the beverage tap plug is provided with a cone-shaped tip connected to the post at the distal end.

In a preferred embodiment, the post of the beverage tap plug defines a cross section generally in the shape of a square such that the post presents four different faces, with each face angled substantially perpendicular to every adjacent face.

Additionally, the fins of the beverage tap plug can be aligned generally perpendicular to the longitudinal axis notwithstanding the slight downward bias of the fins.

In a preferred embodiment, the plurality of fins are composed of four groups, each group extends radially outwardly from a separate face of the post.

Also, the flat base of the beverage tap plug can be wider than the outside diameter of the faucet opening in order to provide easier gripping of the tap plug for insertion and removal.

The absorbent member of the beverage tap plug can preferably be impregnated with a sanitizer comprising a cationic surfactant.

In a second preferred embodiment, the beverage tap plug comprises a support member supporting a resilient absorbent member. The absorbent member comprises a generally cylindrical column of absorbent material.

The support member of the beverage tap plug comprises a relatively flat, disk-shaped base supporting a thin post in which the post defines a longitudinal axis with a first base end and second distal end. The post protrudes outwardly from the center of the base at the base end. The post has a plurality of fins which are arranged in a generally continuous spiral pattern from the base end to the distal end and extending radially outwardly from the post.

In a third embodiment, the beverage tap plug comprises a support member supporting a resilient absorbent member. The absorbent member comprises a generally cylindrical column of absorbent material.

The support member of the beverage tap plug comprises a relatively flat, disk-shaped base supporting a thin post in which the post defines a longitudinal axis with a first base end and second distal end. The post protrudes outwardly from the center of the base at the base end. The post has a single continuous screw type threading from the base end to the distal end in lieu of the plurality of fins in other embodiments.

BRIEF DESCRIPTION OF THE DRAWINGS

FIG. 1 is a perspective view of the present invention showing a view of a beverage tap plug placed inside the faucet opening of a beverage tap.

FIG. 2 is an exploded view of the beverage tap plug of FIG. 1 from the distal end showing the structure of the beverage tap plug, with absorbent member 30 impregnated with a disinfectant, sanitizer, or cleaning solution.

FIG. 3 is top plan view of the support member with the cone shaped tip pointing upwardly at the distal end.

FIG. 4 is a cross section views of the beverage tap plug of FIG. 1 taken along line 4-4 and looking in the direction of the arrows showing the fins engaging the inside surface of the absorbent member.

DETAILED DESCRIPTION OF THE DRAWINGS

Figure 5:
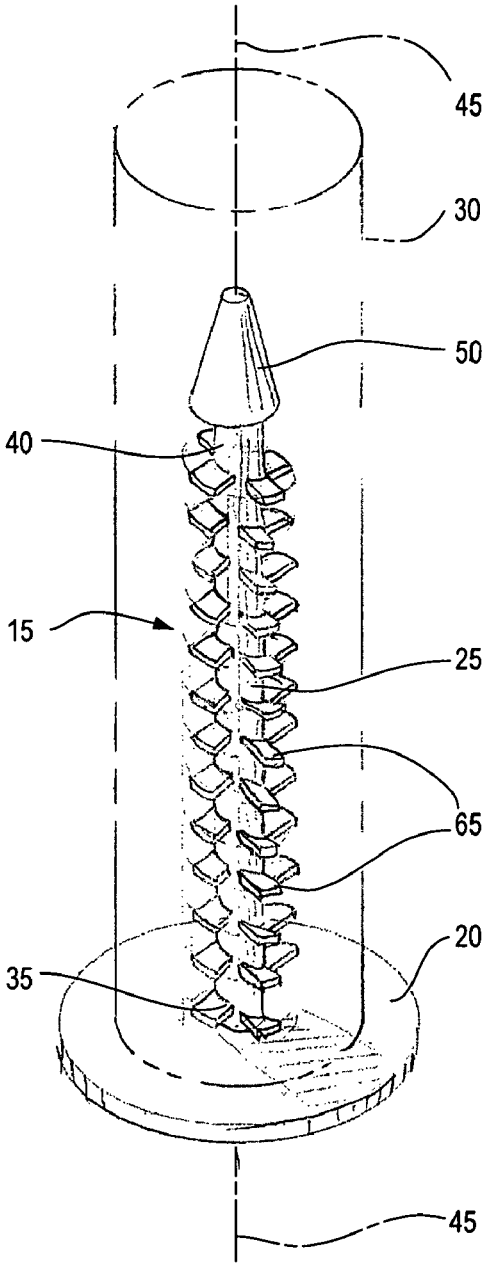
FIG. 5 is a perspective view of a second embodiment of the support member in which the fins are arranged in a generally continuous spiral pattern from the base end to the distal end.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

As shown in FIG. 1, beverage tap plug 10, in one preferred embodiment, comprises absorbent member 30 enclosing support member 15.

Support member 15 comprises flat base 20 and post 25 protruding from flat base 20. Flat base 20 can be any shape; however, in this preferred embodiment flat base 20 is generally circular in shape.

Beverage tap plug 10, after being impregnated with a disinfectant, sanitizer, or other cleaning agent, is inserted into the faucet opening of beverage tap 60. In a preferred embodiment, flat base 20 is wider than the diameter of the outer rim of the faucet opening in order to provide for easier gripping and removal of beverage tap plug 10.

FIG. 2 shows post 25 defining longitudinal axis 45 and having base end 35 and distal end 40. Post 25 is attached to flat base 20 at base end 35 such that it is protruding from the center of flat base 20. Post 25 can have a generally square cross section. Post 25 also has cone tip 50 attached to distal end 40. Post 25 has plurality of fins 65 protruding radially outwardly from longitudinal axis 45. Plurality of fins 65 are relatively thin, flat projections and are arranged generally perpendicular to longitudinal axis 45. Plurality of fins 65 have a slight downward bias toward base end 35.

Support member 15 can be composed of a wide variety of materials. However, support member 15 is preferably made of plastic.

Absorbent member 30 is generally cylindrical in shape and has a hole 70 defining inside surface 75 to allow the insertion of post 25. The outside diameter of absorbent member 30 is greater than the inside diameter of the faucet opening of beverage tap 60. Absorbent member 30 can be composed of any acceptable absorbent material recognized by one of skill in the art to be capable of being impregnated with a disinfectant, sanitizer or cleaning solution.

As demonstrated by FIG. 1, absorbent member 30 is secured to post 25 via plurality of fins 65 that grab or catch inside surface 75.

As shown by FIG. 3, cone tip 50 has notches 55 such that cone tip 50 has a cross shaped cross section.

FIG. 4 is cross section of the beverage tap plug showing plurality of fins 65 engaging inside surface 75. Also shown by FIG. 4 is cationic surfactant 61 impregnating absorbent member 30.

FIG. 5 shows support member 15 of a second embodiment of a beverage tap plug. FIG. 5 shows support member comprising a flat base 20 and post 25 protruding from flat base 20.

Post 25 defines longitudinal axis 45 and has base end 35 and distal end 40. Post 25 is attached to flat base 20 at base end 35 such that it is protruding from the center of flat base 20. Post 25 has a circular cross section. Post 25 also has cone tip 50 attached to distal end 40. Post 26 has a plurality of fins 65 protruding radially outward from longitudinal axis 45. The plurality of fins 65 are relatively thin, flat projections and are arranged generally perpendicular to longitudinal axis 45. Plurality of fins 65 are also arranged in a generally continuous spiral pattern from base end 35 to distal end 40.

Figure 6:
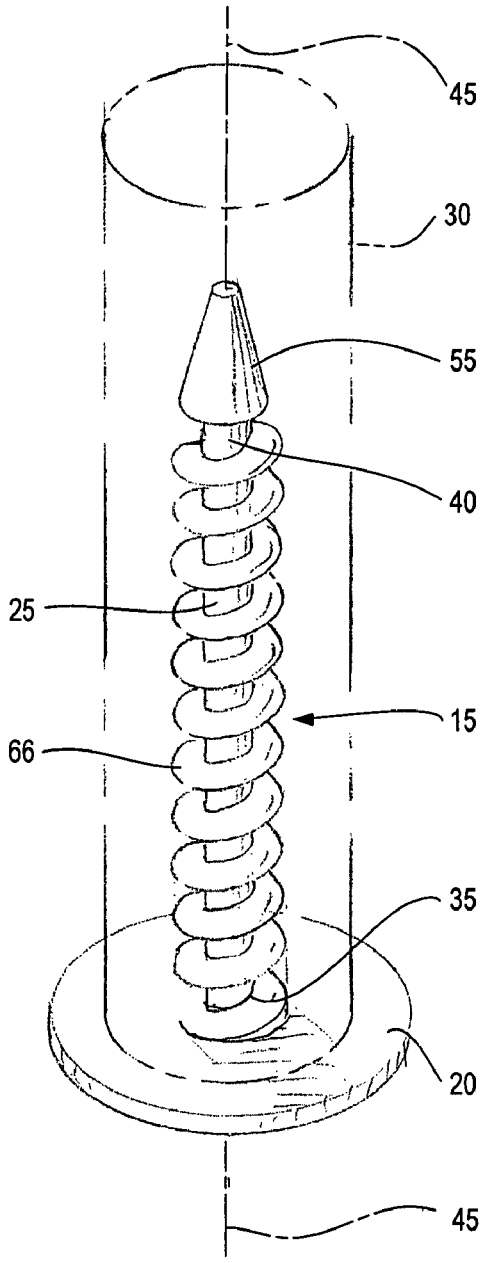
FIG. 6 is a perspective view of a third embodiment of the support member in which the fins are replaced by a continuous screw type threading from base end to distal end.

FIG. 6 shows support member 15 of a third embodiment of a beverage tap plug. FIG. 6 shows support member comprising a flat base 20 and post 25 protruding from flat base 20.

Post 25 defines longitudinal axis 45 and has base end 35 and distal end 40. Post 25 is attached to flat base 20 at base end 35 such that it is protruding from the center of flat base 20. Post 25 has a circular cross section. Post 25 also has cone tip 50 attached to distal end 40. Post 25 has a continuous screw type threading 66 from base end 35 to distal end 40.

While many different disinfectants, sanitizers or cleaners may be used, a preferred sanitizer would comprise any one of a number of available cationic surfactants. Once the beverage tap plug is removed it is preferable to wait thirty seconds before drafting any beverage, especially any carbonated beverage, in order to prevent any loss of head from the beverage.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A combination comprising:

a beverage tap faucet, having an open end with an internal surface with an internal diameter, and an external diameter, and a beverage tap plug for occupying and disinfecting, sanitizing, or cleaning the open end of the beverage tap faucet, the beverage tap plug further comprising:

a support member, said support member comprising a flat base having a center, said flat base being attached to a thin post, said post defining a longitudinal axis having a base end and a distal end, and protruding outwardly from the center of said base at said base end; and a resilient absorbent member, enclosing and extending axially beyond the distal end of the post of the support member and comprising a substantially cylindrical column with an outside uncompressed diameter larger than the internal diameter of the open end of the beverage tap faucet, the flat base of the support member having an outside diameter greater than the outside uncompressed diameter of the resilient absorbent member, said absorbent member being impregnated with at least one of a disinfectant, sanitizer, and cleaner for compressed receipt and maintenance within, and chemical interaction with, the internal surface of the open end of the beverage tap faucet.

2. The beverage tap plug of claim 1 further comprising a plurality of fins, said fins extending radially outwardly from the post.

3. The beverage tap of claim 2 wherein the plurality of fins extends along substantially the entire length of the post.

4. The beverage tap plug of claim 3 wherein the fins are aligned generally perpendicular to the longitudinal axis.

5. The beverage tap plug of claim 4 wherein the fins have a slight downward bias toward the base end of the post.

6. The beverage tap plug of claim 5 wherein the plurality of fins are composed of four groups, each group extending radially outwardly from a separate face of the post.

7. The beverage tap plug of claim 2 further comprising a cone-shaped tip, said cone-shaped tip connected to the post at the distal end.

8. The beverage tap plug of claim 2 wherein the post is defining a cross section, the cross section being generally in the shape of a square such that the post presents four different faces, each face angled perpendicular to an adjacent face.

9. The beverage tap plug of claim 2 wherein the flat base is wider than the external diameter of the open end of the beverage tap faucet in order to provide easier gripping of the tap plug.

10. A combination comprising:

a beverage tap faucet, having an open end with an internal surface with an internal diameter, and an external diameter, and a beverage tap plug for occupying and disinfecting, sanitizing, or cleaning the open end of the beverage tap faucet, the beverage tap plug further comprising:

a support member, said support member comprising a flat base having a center, said flat base being attached to a thin post, said post defining a longitudinal axis having a base end and a distal end, and protruding outwardly from the center of said base at said base end; and a resilient absorbent member, enclosing the post of the support member and comprising a substantially cylindrical column with an outside uncompressed diameter larger than the internal diameter of the open end of the beverage tap faucet, the flat base of the support member having an outside diameter greater than the outside uncompressed diameter of the resilient absorbent member, the flat base of the support member abutting one end of the resilient support member, said absorbent member being impregnated with at least one of a disinfectant, sanitizer, and cleaner for compressed receipt and maintenance within, and chemical interaction with, the internal surface of the open end of the beverage tap faucet; and a plurality of fins extending radially outwardly from the post for maintaining the absorbent member in position on the support member and wherein the fins are arranged in a generally continuous spiral pattern from the base end to the distal end.

11. A combination comprising:

a beverage tap faucet, having an open end with an internal surface with an internal diameter, and an external diameter, and a beverage tap plug for occupying and disinfecting, sanitizing or cleaning the open end of the beverage tap faucet, the beverage tap plug further comprising:

a support member, said support member comprising a flat base having a center, said flat base being attached to a thin post, said post defining a longitudinal axis having a base end and a distal end, and protruding outwardly from the center of said base at said base end; and a resilient absorbent member, enclosing the post of the support member and comprising a substantially cylindrical column with an outside uncompressed diameter larger than the internal diameter of the open end of the beverage tap faucet, the flat base of the support member having an outside diameter greater than the outside uncompressed diameter of the absorbent member, said absorbent member being impregnated with at least one of a disinfectant, sanitizer, and cleaner for compressed receipt and maintenance within, and chemical interaction with, the internal surface of the open end of the beverage tap faucet; and a continuous screw threading for maintaining the absorbent member in position on the support member, said continuous screw threading extending from the base end to the distal end of the support member.

* * * * *